US006261514B1

(12) United States Patent
Lindberg et al.

(10) Patent No.: US 6,261,514 B1
(45) Date of Patent: Jul. 17, 2001

(54) METHOD OF PREPARING SINTERED PRODUCTS HAVING HIGH TENSILE STRENGTH AND HIGH IMPACT STRENGTH

(75) Inventors: Caroline Lindberg; Johan Arvidsson, both of Nyhamnsläge (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/584,104

(22) Filed: May 31, 2000

(51) Int. Cl.[7] ..... B22F 3/12
(52) U.S. Cl. ..... 419/11; 419/36; 419/38
(58) Field of Search ..... 419/36, 38, 11

(56) References Cited

U.S. PATENT DOCUMENTS

| | | | |
|---|---|---|---|
| 5,484,469 | 1/1996 | Rutz et al. | 75/252 |
| 5,728,238 | 3/1998 | Engdahl et al. | 148/337 |
| 5,744,433 | 4/1998 | Storström et al. | 508/454 |

FOREIGN PATENT DOCUMENTS

| | | |
|---|---|---|
| 0653262 | 5/1995 | (EP) . |
| WO 98/03291 | 1/1998 | (WO) . |
| WO 99/37424 | 7/1999 | (WO) . |

*Primary Examiner*—Ngoclan Mai
(74) *Attorney, Agent, or Firm*—Burns, Doane, Swecker & Mathis, L.L.P.

(57) ABSTRACT

The invention concerns a method of preparing sintered products having high tensile strength and high impact strength comprising the steps of forming a mixture by mixing an iron powder including 1–4% by weight of Cr, 0.2–0.8% by weight of Mo 0.09–0.3% by weight % of Mn, less than 0.01% of C, less than 0.25% by weight of O, 0–1.2% of graphite, a high temperature lubricant and optionally an organic binder; preparing a heated powder composition by heating the mixture to a temperature above ambient temperature; transferring the heated powder composition to a preheated die; forming a compacted body by compacting the heated powder composition in the die at an elevated temperature; and forming a sintered product by sintering the compacted body at a temperature of at least 1220° C.

4 Claims, No Drawings

METHOD OF PREPARING SINTERED PRODUCTS HAVING HIGH TENSILE STRENGTH AND HIGH IMPACT STRENGTH

TECHNICAL FIELD

This invention relates to the art of powder metallurgy and more particularly to a method of preparing sintered products, which combine the two properties high strength and high toughness, which normally are not present in one and the same product.

BACKGROUND ART

In general, sintered products made by powder metallurgy are advantageous in cost over ingot steels obtained through forging and rolling steps and has wide utility as parts of motor vehicles and office automation apparatus. However, the sintered product has pores which are inevitably formed during the course of its fabrication. These remaining pores of the sintered powder-metallurgical materials impairs the mechanical properties of the materials, as compared with completely dense materials. This is a result of the pores acting as stress concentrations and also because the pores reduce the effective volume under stress. Thus, strength, ductility, fatigue strength, macro-hardness etc. in iron-based powder-metallurgical materials decrease as the porosity increases. Impact energy is, however, the property the most adversely affected.

Despite their impaired impact energy, iron-based powder-metallurgical materials are, to a certain extent, used in components requiring high impact energy. Naturally, this necessitates high precision when manufacturing the components, the effect of the porosity on impact energy being well-known.

The impact energy of sintered steel may be increased by alloying with Ni, which augments the strength and ductility of the material and, furthermore, causes shrinkage of the material, i.e. a density increase. There is, however, an increasing demand for powders which do not contain nickel since, inter alia, nickel is expensive, gives dusting problems during the processing of the powder, and causes allergic reactions in minor amounts. From an environmental point of view, the use of nickel should thus be avoided Sintered components having high impact strength without using Ni as alloying element are disclosed in U.S. Pat. No. 5,728,238. This patent discloses that it is possible to obtain impact strength of up to 100 J by using an iron-based powder which, in addition to Fe, contains Mo and P, and in which the content of other alloying elements is maintained on a low level. This material is, inter alia, characterised by the fact that sintering even below 1150° C. results in an impact energy which is higher than that of powder-metallurgical materials sintered at higher temperatures. Further, the material has excellent compressibility and is capable of considerable shrinkage, giving a sintered material of high density. For one and the same density, this known material has a substantially higher impact energy than today's powder-metallurgical materials. A serious restriction, however, is that these sintered products have relatively low tensile strength of about 430 MPa.

OBJECTS OF THE INVENTION

An object of the invention is to provide sintered components combining high tensile strength and high impact strength. In this context the term high tensile strength means values above about 700 MPa and high impact strength values above about 45 J.

Another object is to provide a simple process for the preparation Of such components by using commercially used powders.

SUMMARY OF THE INVENTION

Unexpectedly, it has now been found that when water-atomised powders including specified amounts of the components Cr and Mo are subjected to a combination of specific compacting and sintering conditions it is possible to obtain sintered products which have not only high tensile strength but also a high impact strength. In accordance with the invention it has thus been found that when the compacting is performed as warm compaction and the sintering as high temperature sintering, products having a tensile strength above about 700 MPa and an impact strength above about 45 J may be obtained.

DETAILED DESCRIPTION OF THE INVENTION

Specifically the method of preparing sintered products having high impact strength and high tensile strength according to the invention comprises the steps forming a mixture by mixing an iron powder including 1–4% by weight of Cr, 0.2–0.8% by weight of Mo 0.09–0.3 by weight % of Mn, less than 0.01% of C, less than 0.25% by weight of O, 0.2–1.2% of graphite, a high temperature lubricant and optionally an organic binder;

preparing a heated powder composition by heating the mixture to a temperature above ambient temperature;

transferring the heated powder composition to a preheated die;

forming a compacted body by compacting the heated powder composition in the die at an elevated temperature; and sintering the compacted body at a temperature of at least 1220° C.

powders having the same or similar composition as those used according to the present invention are previously disclosed in the EP publication 653 262 and SE99/00092 PC. A commercially available powder is Astaloy CrM available from Höganäs AB, Sweden.

The EP publication 653 262 discloses an alloy steel powder for sintered bodies, which is characterised by comprising, by wt %, not more than 0.1% of C, not more than 0.08% of Mn, 0.5–3% of Cr, 0.1–2% of Mo, not more than 0.01% of S, not more than 0.01% of P, not more than 0.2% of O, optionally one or more of 0.2–2.5% of Ni, 0.5–2.5% of Cu, 0.001–0.004% of Nb and 0.001–0.004% of V, and the balance being Inevitable impurities and Fe. A sintered body having high tensile strength, high fatigue strength and high toughness may be prepared from this powder when the sintering is performed at a temperature of 1100–1300° C. and the obtained body is immediately cooled at a cooling rate of 10°–200° C./minute. The powder having the highest impact strength, 3.6 kgfm/mm$^2$ or about 35 Mpa, had the composition 0.03% by weight of Mn, 1% by weight of Cr and 0.3% by weight of Mo (cf. table 6).

The patent publication SE99/00092 discloses a powder composition which differs from the one known from the EP publication above in that the Cr content is limited to a value between 2.5 and 3.5, the Mo content is between 0.3 and 0.7 and the Mn content is limited to 0.09–0.3% by weight. This powder also includes less then 0.25% of O and less than 0.01% of C. An important feature is that sintered products having high tensile strength can be obtained without heat treatments also when the sintering is carried out at low temperatures i.e. temperatures lower than 1220° C. Thus for powders including graphite in amounts ranging from 0.3–0.6% according to this invention low temperature sintered products having tensile strength up to about 1000 MPa and an impact strength up to about 26 J are obtained. The figures of this publication clearly discloses that when the tensile strength increases the impact strength decreases.

These two publications disclose sintered products including the two alloying elements Cr and Mo which products have high tensile strength. The impact strength obtained is, however, moderate.

Preferably the powders used according to the present invention essentially consist of, in % by weight, Cr 2.5–3.5, Mo 0.3–0.7, Mn 0.09–0.15, Cu<0.10, Ni<0.15, P<0.02, N<0.01 V<0.10, Si<0.10, W<0.10, the balance being iron and, an amount of not more than 0.5%, inevitable impurities.

The graphite addition according to the present invention may vary between 0.1 and 1.2, preferably between 0.2 and 0.7% by weight of the composition. Sintered products having the valuable combination of high tensile strength and high impact strength may also be obtained without graphite addition on the assumption that the sintering is performed during carburizing conditions, i e in an atmosphere including a carbon containing gas such as methane, propane. A combination of graphite addition and carburizing atmosphere might also be used. The carbon content of the sintered product should be above about 0.1% by weight, most preferably above about 0.2 and most preferably above 0.25% irrespective of the method of incorporation of carbon, i.e. graphite addition, carburization or combinations thereof. The upper limit for the C content of the sintered product is about 0.6. Preferably the sintered products should have a carbon content between 0.25 and 0.5.

The high temperature lubricant may be any of recently developed lubricants or mixtures thereof which are useful for warm compaction. Specific examples of suitable lubricants are disclosed in e.g. the U.S. Pat. Nos. 5,484,469 and 5,744,433. The amount of lubricant may vary between 0.3 and 1, preferably between 0.4 and 0.8% by weight of the composition to be compacted.

The binder used in the metal-powder composition may consist of e.g. cellulose ester resins, hydroxyalkyl cellulose resins having 1–4 carbon atoms in the alkyl group, or thermoplastic phenolic resins.

The mixture of the powder, lubricant and, optionally, binder is heated to a temperature above ambient temperature, preferably above 100° and most preferably above 120° C.

The obtained preheated mixture is subsequently transferred to a preheated die and compacted at a pressure between 600 and 1200 MPa.

After the compaction the released green compact is sintered at a temperature between 1220° C. and 1300° C. in hydrogen and/or nitrogen based atmosphere such as $90N_2/10H_2$.

The invention is further illustrated by the following example.

Steel powders having Cr content of 3% by weight, an Mo content of 0.5% by weight and an Mn content of 0.11% by weight were water-atomised and annealed as described in the patent application PCT/SE 97/01292. Graphite (C-UF4) in amounts varying from 0.3 to 0.7% by weight was added as well as 0.6% by weight of a lubricant, Advawax®. The powders were compacted at 700 MPa and then sintered in an atmosphere of 95% $N_2/5H_2$ for 60 minutes at 1250° C.

The following table discloses the green density (GD), the tensile strength (TS), and the impact energy (Charpy) for the products prepared.

| Graphite added % | GD g/cc | TS MPa | Charpy J |
|---|---|---|---|
| 0.2 | 7.3 | 716 | 50 |
| 0.35 | 7.29 | 859 | 51 |
| 0.5 | 7.27 | 947 | 59 |

What is claimed is:

1. A method of preparing sintered products having high impact strength and high tensile strength comprising the steps of:

forming a mixture by mixing an iron powder including 1–4% by weight of Cr, 0.2–0.8% by weight of Mo, 0.09–0.3% by weight of Mn, less than 0.01% of C, less than 0.25% by weight of O, 0–1.2% of graphite, a high temperature lubricant and optionally an organic binder;

preparing a heated powder composition by heating the mixture to a temperature above ambient temperature;

transferring the heated powder composition to a preheated die;

compacting the heated powder composition in the die at an elevated temperature; and forming a sintered product by sintering the obtained compacted body at a temperature of at least 1220° C.

2. A method according to claim 1, wherein the sintered products have a carbon content of at least 0.1% by weight, a tensile strength of above about 700 MPa and high impact strength values above about 45 J.

3. A method according to claim 1, wherein the powder has the following composition, in % by weight, Cr 2.5–3.5, Mo 0.3–0.7, Mn 0.09–0.15, Cu<0.10, Ni<0.15, P<0.02, N<0.01, V<0.10, Si<0.10, W<0.10, the balance being iron and, an amount of not more than 0.5%, inevitable impurities.

4. A method according to claim 2, wherein the powder has the following composition, in % by weight, Cr 2.5–3.5, Mo 0.3–0.7, Mn 0.09–0.15, Cu<0.10, Ni<0.15, P<0.02, N<0.01, V<0.10, Si<0.10, W<0.10, the balance being iron and, an amount of not more than 0.5%, inevitable impurities.

* * * * *